US006415798B1

(12) United States Patent
Hersh et al.

(10) Patent No.: US 6,415,798 B1
(45) Date of Patent: Jul. 9, 2002

(54) ANTIOXIDANTS TO NEUTRALIZE TOBACCO FREE RADICALS

(75) Inventors: Theodore Hersh; Rebecca Hersh, both of Atlanta, GA (US)

(73) Assignee: Thione International, Inc., Atlanta, GA (US)

( * ) Notice: Subject to any disclaimer, the term of this patent is extended or adjusted under 35 U.S.C. 154(b) by 0 days.

(21) Appl. No.: 09/608,500

(22) Filed: Jun. 30, 2000

Related U.S. Application Data

(63) Continuation-in-part of application No. 09/185,172, filed on Nov. 3, 1998, which is a continuation-in-part of application No. 08/933,696, filed on Sep. 19, 1997, now Pat. No. 5,829,449.

(51) Int. Cl.[7] ..... A24D 1/04; A24B 3/18; A24B 15/00

(52) U.S. Cl. ..... 131/202; 131/331; 131/334

(58) Field of Search ..... 131/202, 331, 131/334; 96/108, 153

(56) References Cited

U.S. PATENT DOCUMENTS 5,060,672 A * 10/1991 Irimi et al. ..... 131/331
5,829,449 A 11/1998 Hersh et al.
5,906,811 A 5/1999 Hersh
5,922,346 A 7/1999 Hersh

* cited by examiner

*Primary Examiner*—Stanley S. Silverman
*Assistant Examiner*—Dionne A. Walls
(74) *Attorney, Agent, or Firm*—Crosby, Heafey, Roach & May

(57) ABSTRACT

A composition for inclusion within a cigarette, cigar, pipe or smokeless tobacco. The composition can be included within the tobacco itself, a filter for filtering tobacco smoke once burned within the paper or wrapper surrounding the tabacco product. In the cigarette filter, be it internal or external filters, the antioxidant complex is capable of scavenging and neutralizing the free radicals emanating from the burning or heated tobacco and passing through the filter as the smoker inhales. The composition is also capable of reducing free radical damage to the oro-pharyngeal cavity, respiratory tract and lungs resulting from tobacco smoke. The composition includes glutathione and preferaby L-glutathione and sources of the antioxidant enzymes catalase and superoxide dismutase.

14 Claims, No Drawings

ANTIOXIDANTS TO NEUTRALIZE TOBACCO FREE RADICALS

RELATED APPLICATIONS

The present application is a continuation-in-part of U.S. application Ser. No. 09/185,172 filed Nov. 3, 1998 which, in turn, is a continuation-in-part of U.S. application Ser. No. 08/933,696, filed Sep. 19, 1997, now U.S. Pat. No. 5,829, 449.

TECHNICAL FIELD OF THE INVENTION

The present invention deals with the combination of various synergistic antioxidants, enzymatic co-factors and amino acids in appropriate delivery vehicles employed in cigarette filters and in external filters such as cigarette and cigar "holders," in "pipe filters" and in tobacco, wrappers and papers and in so-called smokeless tobacco as a means of preventing or ameliorating signs and symptoms and complications to the oro-pharyngeal cavity, respiratory tract and lungs from damage by tobacco smoke and tobacco chewed induced free radical species. The present invention can be employed in filter cigarettes, unfiltered cigarettes, cigars, pipes, and smokeless tobacco products.

BACKGROUND OF THE INVENTION

The deleterious effects of tobacco abuse are well known and regulatory agencies as well as the public constantly react to these scientific and epidemiologic evidences. Tobacco is indeed a worldwide public health hazard accounting for significant morbidity and mortality. Although smoking places an abundant oxidant insult to the oral cavity, respiratory tract and lungs, evidence supports the notion that the oxidant burden is on the entire organism of the smoker. Smoking promotes development or enhancement of atherosclerosis, causing cardiovascular disease, chronic obstructive pulmonary disease, recently labeled "smoker's lung," cutaneous damage, especially to the face, called "smoker's face," and various forms of cancer, including carcinomas of the mouth, pharynx, esophagus and lung.

Tobacco is a substance consisting of the dried leaves and stems of the plant Nicotiana tabacum. Tobacco contains the drug nicotine, which is very addictive. The plant is native to North America and now is grown worldwide. Tobacco abuse has been identified as the single most preventable cause of disease, morbidity and mortality, for tobacco smoke contains many toxic chemicals, in tar and gas phase smoke.

There are three principal ways to consume tobacco: 1) smoking, 2) chewing and dipping, and 3) snuffing. Fifty million Americans smoke, and countless others are affected by tobacco smoke, the so called secondary or environmental smokers. Children of smokers also breathe this second-hand smoke and have more respiratory problems than children of non-smokers. Smokeless tobacco is used by as many as 12 million individuals and has detrimental effects on the oral cavity plus systemic effects derived from buccal absorption of nicotine and other chemicals.

Cigarette smoke is divided into two phases, tar and gas-phase smoke. Cigarette tar contains high concentrations of free radicals. Common oxidants include semiquinone which is in equilibrium with hydroquinones and quinones, particularly in the viscous tar matrix. Many tar extracts and oxidants, including the latter mentioned, are water soluble and reduce oxygen to its superoxide radical which can dismutate to form $H_2O_2$. Importantly, glass-fiber type cigarette filters retain almost all of the tar particles that are larger than 0.1 micron. Thus, the filter acts as a trap for tars in cigarette smoke. There are an inordinately large number of free radicals, greater than $10^{15}$, in each puff in the gas-phase of cigarette smoke. While oxidants in tar are stable, those organic radicals in gas phase smoke are reactive carbon and oxygen centered radicals with extremely short half lives. Other free radical species, such as the aldehyde species have longer half-lives and may be more deleterious, resulting from lipid peroxidation. Interestingly, concentrations of free radicals from tobacco are maintained at high levels for more than 10 minutes and tend to increase as tobacco smoke is aged. It is thus considered that these gas phase smoke oxidants are in a steady state as they are both continuously formed and destroyed. The latter reactions are similar to those noted to occur in smog, pointing to the extra noxious stimuli to primary and secondary smokers in atmospheric polluted environments.

Various studies have correlated the importance of oxidant stress to various organs resulting from tobacco smoke and other noxious environmental factors and thus continue to exert a toll on the public health of all countries. Significant morbidity and mortality result from smoking tobacco from cigarettes, cigars, and pipes and local oral pathology from both smoking and chewing tobacco. Epidemiologic studies have strongly implicated tobacco in the pathogenesis of atherosclerosis and coronary artery disease, emphysema and various malignancies, including oro-pharyngeal and pulmonary neoplasias. Chronic cigarette smoking is associated with appearance of free radicals inducing oxidative damage. Measurement in blood, urine and tissues of various antioxidants or of by-products of free radical metabolic processes are supportive of tissue oxidant damage in the pathogenesis of various diseases associated with tobacco smoking and environmental pollutants.

Studies have estimated that tobacco smoke has over 3,000 different constituents, of which a number are toxic, some are carcinogenic and many generate free radical species. Most of these compounds have been identified in so-called mainstream and sidestream tobacco smoke. The former is that volume of smoke drawn through the mouthpiece of the tobacco product during puffing while sidestream smoke is that smoke emitted from the smoldering cigarette in between puffs. Although tar and nicotine are retained in the filter of cigarettes, the present invention applies mainly to mainstream smoke, be it drawn through filtered and non-filtered cigarettes. It is noted that the emissions of toxic and carcinogenic components in sidestream smoke are not significantly reduced in filter cigarettes when compared to their non-filter counterparts. Thus, sidestream smoke is a major contributor to environmental smoke, affecting both the smoker and their non-smoking counterparts, so called secondary smokers. The lower rates of consumption of cigarettes with high smoke yields has not reduced the indoor pollutants of carcinogenic substances and free radicals generating potential of tobacco smoke produced in sidestream smoke, albeit their diminished levels in mainstream smoke by smoking low yield tobaccos and filtered cigarettes.

Leukoplakia, a tobacco induced white patch on the buccal mucosa, as found in smokers, is a localized irritation due to direct contact of smoked tobacco and it is directly related to the frequency and years of tobacco abuse. Although leukoplakia is a benign oral lesion, these have a malignant potential, requiring a biopsy of the lesion to rule out cancer. Leukoplakia may regress or resolve completely when use of tobacco products is discontinued.

Over 30,000 new cases of cancer of the oral cavity are diagnosed annually, accounting for two to four percent of all new cancers. Oral cancer kills 8,000 patients each year and only half of cases diagnosed annually have a five year survival. The great majority of these patients are users of tobacco products. Other risk factors include alcohol abuse, nutritional deficiencies and poor oral hygiene.

Tobacco contributes to other oral symptoms or pathologies of the mouth and teeth. Tobacco may cause halitosis, may numb the taste buds, interfere with the smell and the taste of food and may stain teeth and contribute to dental caries. For example, smokers have more dental tartar (calculus) than non-smokers. Tobacco is also associated with destructive periodontal (gum) disease and tooth loss. Acute necrotizing ulcerative gingivitis ("trench mouth") is a destructive, painful inflammatory condition occurring mainly in cigarette smokers. Swelling of the nasal and sinus membranes have also been associated, purportedly, in individuals who are "allergic" to tobacco smoke.

Tobacco, whether smoked as cigarettes, cigars or pipes causes common untoward effects in the oral cavity. Tobacco smoke has two chances to exert its deleterious effects in the mouth—when it is inhaled by the smoker and on its exit during exhalation.

Like cigarettes, evidence shows that cigars are also toxic and addictive. Cigar and cigarette smokers have a similar increased risk for oral and laryngeal cancers but the latter smokers are more prone to contract cancer of the lung, emphysema and cardiovascular disease. While cigarette tobacco is generally flue cured with a resulting mildly acidic product, the slower curing methods for cigars render these mildly alkaline. At this pH, nicotine is more readily absorbed. Unlike cigarettes, cigars are less homogenous and vary in size and nicotine content. Cigar smokers may spend an hour smoking a single large "Havana" although some actively inhale very little of this smoke; however, in non-inhalers, their nicotine levels may be elevated with no toxic co-absorption, as occurs in cigarette smokers. Cigar smokers also commonly hold an unlit cigar in the mouth, exposing the oral cavity to further nicotine by local absorption. Thus, consumption of cigars may produce an equal or greater smoke burden of exposure and locally generated free radicals in the oral cavity which create deleterious effects and a risk of oro-pharyngeal cancer.

Carcinoma of the lung and chronic lung disease have been known to be end stage complications of cigarette abuse. Nicotine tars contain carcinogens and smoking also induces a free radical reaction in the respiratory tract, both putative to the oro-pharyngeal and pulmonary diseases and neoplasias induced by tobacco abuse. Cigarette filters "trap" nicotine tars but not the gas-phase compounds. Epidemiologic studies have been done in various countries to show the differential effects of tar content, amount of cigarettes smoked, type of tobacco smoked, and use of filters on oro-pharyngeal and lung cancer risk in cigarette smokers.

Under the epithelial lining along the respiratory airways there is a rich network of micro vessels which carry systemic blood from the nasal and tracheobronchial arteries. These vessels provide nutrition to the mucosa to enable it to maintain the protective functions. This first line of defense initially is non-injurious and reversible, but overwhelming or chronic and persistent stimuli, as tobacco smoke and other environmental pollutants, may cause pulmonary damage from the oxidative damage of the leucocytes, other free radicals and noxious agents.

In other in vitro studies, gas-phase cigarette smoke was assessed in its filtered and whole (unfiltered) states for oxidative effects on human plasma. Investigators noted the prevalence of lipid peroxidation in plasma after exposure to gas phase smoke, but not to whole cigarette smoke. The reaction of lipid peroxidation did not commence until the endogenous ascorbic acid had been consumed, that is, vitamin C was oxidized completely. They also noted that cigarette smoke exposure caused oxidation of plasma protein thiols (methionine and cysteine amino acid linkages) and low density lipo-proteins. They concluded that lipid peroxidation induced by the oxidants of gas-phase smoke leads to changes in lipoproteins associated with atherogenesis. As noted herein, the synergistic effect of reduced glutathione and ascorbic acid or ascorbic acid derivatives such as their esters, are beneficial in combating tobacco oxidants and in both ameliorating and delaying the effects of tobacco smoke on oral, pharyngeal and respiratory epithelia, on bronchoalveolar fluids and on lung parenchyma.

Cells subjected to oxidative stress may severely affect cellular function and cause damage to membrane lipids, to proteins, to cytoskeletal structures and to DNA. Free radical damage to DNA has been measured as formation of single-strand breaks, double-strand breaks and chromosomal aberrations. Cells exposed to ionizing radiation and cigarette smoke have also been demonstrated to have an increased intracellular DNA damage, hence the frequency of oro-pharyngeal, esophageal, and pulmonary carcinomas in tobacco users.

The lungs have adapted biochemical enzymatic and non-enzymatic antioxidant systems as prevention, limitation or reversal of oxidant damage to the lungs. This is a protective feature to maintain normal pulmonary function, as the respiratory tissues operate in an environment of high partial pressure of oxygen and are continuously exposed to airborne pollutants. Because of their access to the environment, like the skin to oxygen and ultraviolet radiation, the lungs may be damaged by inhaled gaseous and particulate matter, particularly in both active and passive smokers.

Reactive oxidizing species, as induced by inhaled tobacco, smoke, ozone smog and others are important factors in bronchial hyperresponsiveness and inflammatory lung injury. As in other tissues, antioxidant enzymes in the lung include superoxide dismutase (SOD), which converts superoxide to hydrogen peroxide and catalase which reduces hydrogen peroxide to water. This reaction may also be catalyzed by the selenium cofactor enzyme glutathione peroxidase using reduced glutathione (GSH) as a substrate. Glutathione peroxidase may also reduce lipid peroxide to the corresponding alcohols also using reduced glutathione.

The ubiquitous non-enzymatic thiol tripeptide, glutathione (GSH), plays a vital function in maintaining the integrity of the reactive oxygen species-free radical sensitive cellular components. This is accomplished through its direct role as an antioxidant, in its reduced (GSH) form, as well as a cofactor, as aforementioned. GSH has been detected in bronchoalveolar lavage fluid. In cells, GSH is oxidized in this process to GSSG, but its cellular concentrations for antioxidant activity is maintained in equilibrium by the enzyme glutathione reductase, consuming NADPH as the source of reducing equivalents. Under states of GSH depletion, including malnutrition and severe oxidative stress, as in smoking, cells may become injured and die.

The solid phase (tar) of tobacco contains high concentrations of stable free radicals. These have been identified as semiquinones which are in equilibrium with quinones and hydroxyquinones. These free radicals are capable then of reducing molecular oxygen to form the toxic free radical called superoxide. Superoxide, upon dismutation, can form the injurious molecule hydrogen peroxide ($H_2O_2$). The typical Cambridge glass-fiber filter is able to withhold over 99% of particles greater than 0.1 um, but this filter does not trap superoxide or $H_2O_2$, which are thus inhaled by the smoker. However, gas-phase smoke contains over $10^{15}$ organic radicals per each puff. In contrast to stable free radicals, these have a half-life of 1 second yet are capable of maintaining their high levels of activity in the gas phase smoke for over 10 minutes. This smoke also results in the creation of the $H_2O_2$ through the smoke's production of the toxic hydroxyl radical. The present invention recognizes that the enzyme superoxide dismutase reduces the toxicity of the hydroxyl radical by the dismutation reaction to make the relatively less toxic $H_2O_2$. However, to reduce $H_2O_2$ and other peroxide molecules, the enzymes catalase and glutathione peroxidase are required. The former, catalase, reduces $H_2O_2$ to water and $O_2$.

Hydrogen peroxide, like other tobacco generated free radicals, have been implicated in the etiology of oropharyngeal malignancy and pulmonary neoplasms, in smokers. $H_2O_2$ reacts with the DNA in cells and causes breaks in the double strand which lead to mutations, precursors of malignant cells.

Cigarette smoke also contains aldehydes which are capable of altering protein function by increasing the rate of catabolism. Aldehydes also cause oxidation of the thiol groups of the plasma proteins, thereby oxidizing particularly the low density lipoproteins (LDLs) which transport the "bad" cholesterol. High serum cholesteral levels and/or rapid oxidation of LDLs in plasma are the initial putative steps in the development of atherosclerosis. This is the hallmark lesion that results in coronary heart, cerebrovascular and peripheral vascular diseases. The aldehydes cause these alterations in proteins by their carbonyl group reacting with the thiols and $NH_2$ moieties of the plasma proteins.

SUMMARY OF THE INVENTION

The present invention involves the inclusion of an antioxidant defense system within a filter to be used with tobacco products or within tobacco or within a wrapper for such tobacco products or as applied to smokeless tobacco. The present application utilizes synergistic antioxidants delivered, for example, in tobacco filters such as those for cigarettes or external filters to prevent and ameliorate free radical damage induced by smoking to the oro-pharynx, respiratory tract and lungs. The composition is supplied by inhalation through various state of the art filters. The invention in its broadest terms comprises glutathione plus the antioxidant enzymes catalase and superoxide dismutase. The composition also may incorporate glutathione in its reduced form and a co-ingredient for regenerating the reduced form of the glutathione, the co-ingredient comprising selenium as a selenoamino acid such as selenomethionine or selenocysteine. As further optional ingredients, it is contemplated that the composition may include ascorbic acid and/or one of its derivatives, a sulfur containing amino acid such as L-cysteine, L-taurine and/or L-methionine.

DETAILED DESCRIPTION OF THE INVENTION

The lungs are very susceptible to damage caused by inhaled noxious agents rendering a response to this injury by respiratory epithelial cells and pulmonary vascular endothelium. Bacteria, fungi and viruses may also induce pulmonary infections. All of the aforementioned evoke respiratory tissue free radical reactions and antioxidant-inflammatory responses. Teleologically, the present invention involves, as a front line defense mechanism to inhaled particles and gases and their impact upon the respiratory tract and lungs, the use of active enzymatic and non-enzymatic antioxidants to prevent, minimize, reverse and even repair this oxidant damage. The former includes superoxide dismutase, which converts deleterious superoxide radical to hydrogen peroxide and catalase which reduces $H_2O_2$ to water. This latter reaction may also be catalyzed by selenium containing glutathione peroxidase which may also reduce lipid hydroperoxides, products of oxidant induced lipid peroxidation, to alcohols, also using glutathione as the source of reducing radicals. Thus, the thiol tripeptide, glutathione, (GSH) acts as a direct antioxidant and as a cofactor in reactive oxygen species defense mechanisms. In this process, glutathione becomes oxidized but its cellular concentration as a reduced compound is maintained by the related enzyme glutathione reductase.

The minerals iron and copper of the tar phase contribute to the generation of hydroxyl radicals as well and to the generation of peroxy and alkoxy free radicals and other toxic cellular aldehydes. These radical species are scavenged and neutralized primarily by glutathione peroxidase with its selenium co-factor in the presence of the ubiquitous tripeptide reduced glutathione (GSH) antioxidant. Glutathione, which participates in many detoxifying defensive cellular and body fluid functions, also serves as a substrate in the removal of various metabolic intermediates such as $H_2O_2$, lipid peroxides and organic hydroperoxides by action of the enzyme, glutathione peroxidase. This is the synergy in reducing and neutralizing toxic cigarette free radicals by superoxide dismutase, catalase, glutathione and selenium. The adminstration of the latter, selenium, has been shown not only to itself possess anticarcinogenic properties but it also induces the production of the vital enzyme, glutathione peroxidase. In addition, GSH forms conjugates with smoke's organic free radicals through the action of the glutathione transferases. This GSH mechanism also works in excreting ingested environmental pollutants.

During the process of smoking, pulmonary alveolar macrophages release both superoxide and nitrous oxide. The reaction of these two molecules results in the formation of the toxic radical peroxynitrite ($ONOO^-$). Peroxynitrite appears in greater amounts in the exhaled smoke than in the inhaled smoke. Thus, it is important to reduce the inhalation of superoxide and NO by antioxidants in tobacco products, particularly in the filter of the cigarette, as well as to provide the smoker's body with supplemental antioxidants to help neutralize these oxygen intermediates and the other free radical species inhaled and created by tobacco products. Superoxide dismutase, importantly, catalyzes nitration by peroxynitrite and also catalyzes phenolic compounds, including tyrosine, in protein molecules. Thus, SOD helps reduce the body's oxidative stress induced by smoking, particularly that caused by superoxide and peroxynitrites.

Fractionation of aqueous cigarette tar extracts contain tar radicals that cause damage to DNA. By special analysis, these tar extracts have been identified as catechols and hydroquinones. Aqueous tar extracts that cause damage to DNA produce the reactive oxygen intermediates including superoxide, $H_2O_2$ and hydroxyl radicals. The enzyme catalase inhibits some of this damage, indicating that $H_2O_2$ is the precursor of the hydroxyl radical emanating from tar extracts, responsible at least in part for cigarette smoke's damage to DNA and thereby etiologic of malignancy. See Pryor, et al, *Chem Reseach in Toxicology* 11:441. 1998.

Other non-enzymatic molecules playing an antioxidant role in the lung include the ascorbates (vitamin C); particularly in the extracellular defenses of the lung, as teleologically, it is present in high concentrations in the pulmonary airway lining fluid. Ascorbates as free radical scavengers also react with oxidized glutathione (GSSG) to reduce it to GSH. Also, in the lipid membrane of the cells, the hydrophobic alpha-tocopherols (vitamin E), act synergistically with vitamin C to inhibit lipid peroxidation, as may be induced by cigarette smoke, by actively scavenging lipid peroxides and other free radicals.

The compositions of the present invention can be incorporated in various smoking products. Examples include, but are not limited to, U.S. Pat. No. 3,667,478, dated Jun. 6, 1972, which is herein incorporated by reference and which discloses a filtered cigarette incorporating a stabilized form of an aqueous emulsion of an active vitamin A preparation. This patent teaches that the method provides stability over the length of time before the cigarette is smoked. As taught in U.S. Pat. No. 3,339,558, the cigarette can contain, in front of the filter, a rupturable capsule with a specified amount of Vitamin A as a method of introducing this vitamin into the mouth and respiratory tract of the smoker. Prior to lighting up, pressure is applied to the putative capsule, so that the released active materials are dispersed within the filter, thereby the Vitamin A is accessible to the cigarette smoke passing through. The '478 patent further teaches that stabilized Vitamin A may also be dispersed, impregnated in the tobacco or provided throughout in droplets or beadlets through the employment of gelatin or other colloidal materials, so that the stabilized Vitamin A can be easily entrained by the smoke passing through the filtering elements. Thus, dispersed and random distribution of the small liquid droplets or tiny particulate matter of the Vitamin A preparation is located throughout the tobacco proper or throughout the filtering medium of a filter cigarette. The Vitamin A is surrounded and protected in a method akin to micro-encapsulation.

Irimi and coworkers taught in U.S. Pat. No. 5,060,672, dated Oct. 29, 1991, which is herein incorporated by reference, a highly efficient tobacco smoke filter. They disclosed a composition with mechanical and/or adsorptive filtering materials including a compound being chemically reactive with aldehydes that are not filtered out of the smoke. One such component contains an enediol structure. The '672 patent points out that the synergistic compositions eliminate the excited formaldehyde radical from the tobacco smoke.

It has been noted that tar in smoke may be reduced by using low tar tobaccos and cigarette filters. Other efforts have been directed to reducing toxic and harmful substances in the tobacco itself or by adding these modifications of filters or by adding chemicals to the filters. Caseley taught a method to further reduce aldehydes in tobacco by using non-toxic salts of w-mercapto-alkalene-sulphonates, as well as cysteine and acetylcysteine in U.S. Pat. No. 4,532,947, dated Aug. 6, 1985, which is herein incorporated by reference. These compositions were to be added to cigarette filters or cigarette holders comprising a filter for the purposes of reducing toxic tobacco substances in situ, while smoking cigarettes.

In U.S. Pat. No. 3,972,335, dated Aug. 3, 1976, which is herein incorporated by reference, Tiggelbeck and Mannes disclose a cigarette filter comprising menthol or other smoke-flavoring agents. They taught the use of impregnating a granular activated carbon with a pore modifying agent, like sucrose, and thereby improve the shelf life and delivery of the smoke flavoring agent. Part of the activated carbon is available for adsorption of menthol or other flavors.

In U.S. Pat. No. 5,472,002, dated Dec. 5, 1995, which is herein incorporated by reference, a cigarette filter is taught for administering taurine by inhalation. The patent discloses three methods or devices to administer amino acid to smokers. The disclosure involves a cigarette filter which comprises a filtration material for filtering the smoke from burning tobacco and various means for incorporating taurine therein so that it is introduced into the smoke as it passes through the filter while the cigarette is puffed. Taurine by inhalation has been shown to have preventive and beneficial effects to afflictions of the respiratory tract, including an important mucolytic property. The latter is similar to the action of cysteine, as taught by Puracelli, in U.S. Pat. No. 4,910,222, dated Mar. 20, 1990, also incorporated by reference herein.

A number of investigators have taught further cigarette filtering systems to aid in retention of tobacco smoke tars, nicotine and other toxic chemicals. Choen and Luzio in U.S. Pat. No. 5,009,239 dated Apr. 23, 1991, which is herein incorporated by reference, demonstrated a process for improving selective filter retention and pass through properties of cigarette filter elements. They used a polyethylene imine buffered with organic acids such as formic, propionic, lactic, etc. to a pH range of about 8 to 9.5. In this fashion there was retention of aldehyde and nicotine and by-products by the filter from cigarette smoke.

Brown and co-workers in U.S. Pat. No. 5,249,588, dated Oct. 5, 1993, which is incorporated herein by reference, developed a smoking article which comprised tobacco treated with a high level humectant of 4% to 15% by weight. This smoking article comprised a tobacco rod whereby the rod included cut expanded tobacco and a paper wrapper, with the tobacco having been loaded with the humectant. Von Borstel and Craig also teach a cigarette filter with a humectant in U.S. Pat. No. 5,501,238 dated Mar. 26, 1996, which also is herein incorporated by reference. They disclose sodium pyroglutamate as a humectant plus a surfactant such as an ethoxylate in order to absorb moisture from the tobacco smoke to promote its wet filtration. They also disclose that antioxidants and anti-carcinogenic agents that serve to filter or inactivate the toxic component of smoke may be added. The '238 patent discloses three types of filters to effectively remove tar from smoke: a) conventional cellulose acetate filter, b) cellulose acetate with sodium pyroglutate and c) a commercial wet filtration system.

Lee and Harris disclosed in U.S. Pat. No. 4,964,426 dated Oct. 23, 1993, which is herein incorporated by reference, both tobacco smoke filters and processes for their production.

Applicant's parent applications deal with the synergistic combination of glutathione and a source of selenium. By contrast, the present application contemplates the incorporation of the synergistic combination of glutathione with the antioxidant enzymes catalase and superoxide dismutase in a tobacco product. The antioxidant complex may be incorporated in the internal filters of cigarettes or in external filters, such as those incorporated in cigarette holders. The antioxidant complex can be placed within the tobacco itself in cigarettes, cigars, pipe tobacco and smokeless tobacco or in cigarette papers and cigar leafs.

Without being bound by any theories, it is noted that studies have shown that aqueous extracts of cigarette smoke contain stable oxidants, produced by the interaction of oxygen intermediates and hydrogen peroxide of the gas phase smoke with components of the tar phase during the burning of the tobacco. These oxidants are capable of oxidizing plasma proteins and cause further protein degradation by proteolytic damage from the enzymes present in mitochondria. Glutathione and ascorbic acid do prevent smoke induced protein oxidation. Further protection to other body proteins like albumia from oxidation by tobacco smoke is provided additionally by superoxide dismutase and catalase.

As taught in applicant's parent applications, reduced glutathione is employed in protecting cells against oxidative stress by itself being oxidized. Thus, L-glutathione acts in combination with other enzyme systems in order to be reduced so that it may renew its role as a free radical scavenger. GSH functions also coordinately with the enzyme glutathione peroxidase which requires selenium as a cofactor to exert its biologic antioxidant function. Selenium compounds have been shown to scavenge oxygen-centered radicals in vivo with reduced glutathione through glutathione peroxidase. It is believed that selenium-GSH peroxidase catalyzes toxic hydrogen peroxidase in the presence of reduced glutathione. This reaction reduces glutathione to oxidized glutathione GSSG. In turn, the GSSG is reduced back to GSH by the enzyme glutathione reductase thereby maintaining abundant cellular GSH to scavenge free radicals anew. The preferred version of this invention also takes advantage of this mechanism.

Further, glutathione and selenium act synergistically in vivo as they are both constituents of the same enzymatic system. GSH serves as a specific donor substrate while selenium, provided from alimentary sources or locally from topically applied preparations of selenium, or selenoaminio acids, provides the prosthetic group of GSH peroxidase. The glutathione and selenium antioxidant functions are intrinsically related since by keeping a peroxidase in action, the GSH and selenium, contribute to the removal of the dismutation product of free oxygen radicals, namely, hydrogen peroxide. Herein lies the synergy between glutathione and the enzymes catalase & superoxide dismutase. In a broad sense, GSH and selenium modulate free radical chains initiated or sustained by hydroperoxides. Selenium is used in the present invention for its role as an antioxidant as well as its anticarcinogeriic and antimutagenic properties.

It has now been determined that glutathione can prove to be an effective antioxidant remediating the harmful free radical induced disease species resulting from tobacco consumption by combining glutathione with the enzyme catalase and its synergistic antioxidant partner superoxide dismutase. Optionally, this complex can include the reduced form of glutathione and a selenoamino acid as its cofactor.

The aforementioned compositions may be particularly useful in the prevention and treatment of tobacco smoke or other gaseous or particulate matter exposure. They represent a delicate balance of ingredients which serve not only to reduce the number of free radicals but also to inhibit metabolic oxidation in tissues. The more preferred formulations in accordance with the present invention also enhance the performance of the composition by recycling certain antioxidant ingredients in the formulation after these are absorbed.

In the preferred embodiment of this invention, the synergistic antioxidant complex is a dispersion of active materials throughout the filtering medium of a tobacco filter, although, as noted previously, the complex can also be incorporated in the tobacco itself or in the paper wrapper. The antioxidant complex would be dispersed in the filter as a powder, as a stable solution, or as an aqueous emulsion, which may include the micro-encapsulation of these actives, such as in liposomes. The actives may also be in tiny droplets so that when the smoke produced by the burning tobacco passes through the filter, the smoke will pick up or entrain the powdered complex or the tiny droplets containing the putative antioxidant ingredients. Thus the smoke with the actives is inhaled by the smoker as the smoke enters the oral cavity and then inhaled into the respiratory tract and lungs of the individual. The antioxidants will then be able to neutralize and scavenge the free radicals both in the tobacco smoke itself and those generated by the deleterious tobacco smoke in the oral cavity and respiratory tract, and thereby the complex will exert its beneficial effects locally in the mucosa and tissues of the smoker.

As noted above as an alternative in both filtered and unfiltered cigarettes, it is contemplated that the present antioxidant complex be dispersed throughout the tobacco charge of the product. Although these active ingredients can be localized near the distal end of the filter tip or the proximal opening of the unfiltered tobacco product, the antioxidant complex may also be uniformly and evenly distributed throughout the entire product. Thus, particularly by employing micro-encapsulation techniques such as oral liposomes, these active ingredients may be administered in the filtering medium of a filtered cigarette and within the tobacco charge of these, or of non-filtered cigarettes and cigars and in smokeless tobacco.

In order to protect the active ingredients of this invention, various encapsulating or chemically protective techniques are available such as are well known in the art. The actives may be incorporated in micro-encapsulation vehicles such as liposomes, glycospheres and nonospheres. Such vehicles for oral use are well known to the cosmeceutical industry. Liposomes are lecithin spheres that form an oil protective membrane around the active ingredient compositions of this invention. The liposome entrapped active ingredients travel from the tobacco product and are delivered to the oral cavity where locally they exert both their preventative and therapeutic functions to neutralize the various free radical species. In addition, the antioxidants may also be absorbed as usual by the buccal mucosa for systemic use. It is noted that Unger and co-workers have taught therapeutic drug delivery systems comprising gas filled liposomes which encapsulate the active preparation in U.S. Pat. No. 5,580,573 dated Dec. 3, 1996 which is herein incorporated by reference. Earlier, Chakrabarti disclosed preparations comprising a lipid and a modified peptide using liposomes as delivery vehicles. See U.S. Pat. No. 5,380,531 dated Jan. 10, 1995 which is also herein incorporated by reference. Knight and co-workers in U.S. Pat. No. 5,049,388 dated Sep. 17, 1991 which is also herein incorporated by reference, discloses small particle aqueous aerosol droplets containing liposomes. The patentees taught the inclusion of a drug or medication interacted within the liposome membrane so that when the latter ruptures the active ingredient is not lost from the liposome. The inventors teach various method of preparation of the aerosol particles containing liposomes.

Liposome particles as contemplated herein have a diameter of less than five microns and can easily be prepared in uniform size with the active ingredients for dispersion in the filtering material of a cigarette filter or in a rupturable aqueous capsule which contains the liposome encapsulating the antioxidants. In each case, the active composition in the liposomes would be inhaled by the smoker with each puff, thereby neutralizing free radicals in the oro-pharynx and respiratory tract and lungs generated by the tobacco smoke.

Alternatives to placing the antioxidants of this invention in the filter, tobacco or in encapsulations in front of the filter is to affix these in a treated cigarette paper. This would reduce particularly the free radicals in the sidestream smoke which are particularly injurious to those exposed to secondary smoke as well as to the primary smoker in both main stream and side stream smoke. Chad and co-workers disclosed in U.S. Pat. No. 5,540,242, dated Jul. 30, 1996, which is herein incorporated by reference, a method for reducing side-stream smoke by incorporating additives in the cigarette smoke. Their paper includes an alginate as a film forming agent in combination with a burn additives in the form of alkali metal salts such as potassium succinate, citrate or acetate to form a coating that will reduce sidestream smoke. The synergistic group of antioxidants of this invention may be incorporated in the cigarette paper to not only reduce sidestream smoke, but also to neutralize free radicals in inhaled tobacco smoke. The paper so treated will not produce an off-taste, modify ash appearance, or reduce the cigarette's puff count. The filter, may as well contain powdered antioxidant complex to be inhaled by the smoker and may or may not contain a menthol flavor, as is known in the art.

In a preferred embodiment of this invention, the active ingredients comprise a group of synergistic antioxidants employed in the following dosages in the filter of each cigarette. It must be recognized that to express the amount per pack of cigarettes, each value will be multiplied by 20, the usual numbers of cigarettes sold in one pack, with 10 packs in one carton. The ranges of each ingredient are expressed whether each is dispersed in the filtering material of each cigarette, as a powder or a gel or encapsulated in beads or admixed with a super absorber such as any acrylamide co-polymer or as polyvinyl alcohol engrafted with maleic anhydride. In the latter case, the actives are first solubilized in glycerin and then mixed with the superabsorber in proportions ranging from at least 1 to 1,000 parts of actives to at least 1 to 10,000 parts of the super-absorber depending on its capacity to hold an aqueous glycerin based active complex.

In another preferred embodiment of this invention, the active synergistic anti-oxidants are first micro-encapsulated in such protective phospholipid vehicles as oral liposomes or by other state of the art micro-encapsulation techniques, as already noted and which are well known in this industry for protection of oral drugs, vitamins, amino acids and peptides.

The active ingredients are as follows:

1. Glutathione, and preferably L-glutathione in an amount between at least 0.01 mg. to 20 mg., preferably from 0.10 to 10 mg, most preferably from 1.0 mg to 5.0 mg per cigarette.
2. The antioxidant enzyme catalase in amounts of 0.1 parts per million to 10,000 parts per million and its synergistic antioxidant partner, superoxide dismutase also in a range from 0.1 ppm to 10,000 ppm.

Optional Ingredients

3. L-selenomethionine or I-selenocysteine at a concentration to yield at least 0.01 mcgm to 10 mcgm of selenium, preferably 1.0 to 2.5 mcg selenium per cigarette.
4. L-cysteine and/or its ester, n-acetyl-I-cysteine in a range of 0.1 mg to 10.0 mgs., preferably from 0.5 mg to 5.0 mgm and most preferably from 1.0 mgs to 2.5 mgm, per cigarette.
5. Vitamin C as ascorbic acid or as an ascorbyl palmitate or other ascorbic acid esters alone or microencapsulated such as in liposomes from 0.1 mg to 60.0 mg, preferably from 0.5 mg to 30.0 mgm, most preferably from 1.0 mgm to 3.0 mgm per cigarette.

In each instance, the above noted level of ingredients are based upon a single cigarette filter whether contained within the filter as being absorbed upon the filter material or as a rupturable capsule or as a separate stand alone filter for use with cigars, pipes and unfiltered cigarettes. When used in cigars or as additives to pipe tobacco, the gross amounts of the above-noted ingredients can be adjusted in proportion to the amount of tobacco as compared to the amount of tobacco contained in the typical cigarette.

Other optional ingredients can be used in the tobacco or in the filter which may include those ingredients which are known to bind, or chemically alter noxious molecules, such as aldehydes found in tobacco smoke. The putative antioxidants of this invention are used to neutralize the free radicals found in tobacco as well as those generated by tobacco smoke in the oral cavity, as the antioxidants are inhaled from the filter in the smoke with each puff.

Experimental Data

The effects of tobacco gas phase smoke were studied in cell structures. The cell lines studied included WI-38 fetal lung fibroblasts and both 26 and 83 year old dermal fibroblasts. Cells were grown in flasks until confluence was reached prior to study and kept as in an incubator and in culture media as is standard for cell culture techniques. To test the hypothesis that tobacco gas phase free radicals cause alterations in all physiology and cell viability, a smoking device was assembled so that the smoke of one cigarette, passing through an accessory cellulosic filter, can be bubbled through the cell culture media. The lit cigarette smokes itself by the action of a vacuum pump. The control test is that of one cigarette. In the test case, the antioxidant complex is placed in the accessory cellulosic filter, so that this becomes the gas phase antioxidant treated smoke.

In the control or test study, the cell culture media is placed on the fibroblast cell line being studied and the survival of the cells is monitored for 48 hours using the Alamar Blue Dye technique.

In the experiment, the cells were first trypsinized with 0.25% trypsin and then are plated into 96 well plates and incubated at 37° C. Cells were then treated with the tobacco smoke which was bubbled in the culture media with suitable dilutions of this aquenous solution. Suitable positive (untreated) cells and negative (ethanol treated) cells were used as controls. As noted, the free radical scavenger antioxidant complexes tested were placed in liposomes as a coating within the accessory cellulosic filter affixed to the cigarette.

The compositions studied were as follows:

A.
0.2 mg L-glutathione
0.01 mcgm L-selenomethionine

B.
0.2 mg L-glutathione
0.01 mcgm L-selenomethionine
500 ppm SOD

C.
0.2 mg L-glutathione
0.01 mcgm L-selenomethionine
500 ppm catalase

D.
0.2 mg L-glutathione
0.01 mcgm L-selenomethionine
500 ppm super oxide dismutase
500 ppm catalase Results:

The following data was drawn from some of these studies:

| | Untreated | Treated |
|---|---|---|
| WI-38 Fetal cells | 60% | 84% |
| 26 yr old | 52% | 80% |
| 83 yr old | 10% | 78% |

Chart 2: WI-38 Fetal Cell Line—Alamar Blue Dye Test

| | Cell Viability |
|---|---|
| Untreated smoke: | 52% |
| Treated smoke: | |
| Composition A | 83% |
| Composition B | 92% |
| Composition C | 100% |
| Composition D | 100% |

As noted, tobacco gas phase smoke resulted in significant cell death. This effect is accentuated in the senescent cell lines compared with the younger cell lines, including the WI-38 fetal cells. The free radical scavengers reduced gas phase free radical species and significantly reduced acute cell mortality in all the cell lines of the various ages that were studied. Addition of the antioxidant enzymes to the free radical scavengers complex based on glutathione further reduced or even eliminated cell death from the treated tobacco gas phase smoke. The addition of the full complex in the filter of the cigarette shows there is marked protection to cytotoxicity to cell lives in culture media following gas phase cigarette smoke exposure.

I claim:

1. A filter for filtering smoke generated by a tobacco product, said filter comprising a filtration material for filtering the smoke from burning tobacco which passes through said filtration material and an antioxidant composition which is dispensed into said smoke as it passes through said filtration material, said composition comprising glutathione and enzymes catalase and superoxide dismutase.

2. The filter of claim 1 wherein said glutathione is L-glutathione and said composition further comprises a source of selenium selected from the group consisting of L-selenomethionine and L-selenocysteine.

3. The filter of claim 1 further comprising vitamin C as a member selected from the group consisting of ascorbyl palmitate and ascorbic acid esters.

4. The filter of claim 1 further comprising a member selected from the group consisting of L-cysteine and N-acetyl-L-cysteine.

5. The filter of claim 1 further comprising vitamin A.

6. The filter of claim 1 for inclusion within a cigarette further comprising vitamin E which is contained in an amount between approximately 0.01 I.U. to 10.0 I.U.

7. The filter of claim 1 wherein said antioxidant composition is encapsulated as a member selected from the group consisting of liposomes, glycospheres and nanospheres.

8. The filter of claim 1 wherein said antioxidant composition is incorporated within said filter as a powder.

9. The filter of claim 1 wherein said antioxidant composition is incorporated within said filter as a gel.

10. The filter of claim 1 wherein said antioxidant composition is contained within an aqueous solution in the form of a rupturable capsule.

11. The filter of claim 2 wherein said composition of L-glutathione is contained with an amount between at least 0.01. to 20 mgs and the source of selenium is contained in an amount between approximately 0.01 to 10 mcgm.

12. The filter of claim 2 wherein said antioxidant composition is encapsulated as a member selected from the group consisting of liposomes, glycospheres and nanospheres.

13. The filter of claim 3 wherein said vitamin C is contained in an amount between approximately 0.1 mgs to 60 mgs.

14. The filter of claim 4 for inclusion within a cigarette wherein said L-cysteine or N-acetyl-L-cysteine is contained in an amount between approximately 0.1 mgs to 10 mgs.

* * * * *

UNITED STATES PATENT AND TRADEMARK OFFICE

CERTIFICATE OF CORRECTION

PATENT NO. : 6,415,798 B1
DATED : July 9, 2002
INVENTOR(S) : Hersh et al.

It is certified that error appears in the above-identified patent and that said Letters Patent is hereby corrected as shown below:

Title page,
Item [57], ABSTRACT,
Line 4, delete "tabacco" and insert therefor -- tobacco --.

Signed and Sealed this

Twenty-seventh Day of August, 2002

*Attest:*

*Attesting Officer*

JAMES E. ROGAN
*Director of the United States Patent and Trademark Office*